US007591675B2

(12) United States Patent
Ratican

(10) Patent No.: US 7,591,675 B2
(45) Date of Patent: Sep. 22, 2009

(54) HANGING LAMP CONVERSION CONNECTOR

(76) Inventor: Walter Ratican, 443 NE. Little Mullet Ct., Port St. Lucie, FL (US) 64983

( * ) Notice: Subject to any disclaimer, the term of this patent is extended or adjusted under 35 U.S.C. 154(b) by 0 days.

(21) Appl. No.: 12/286,174

(22) Filed: Sep. 29, 2008

(65) Prior Publication Data

US 2009/0035988 A1 Feb. 5, 2009

Related U.S. Application Data

(63) Continuation of application No. 11/880,176, filed on Jul. 20, 2007, now abandoned.

(51) Int. Cl.
*H01R 13/60* (2006.01)

(52) U.S. Cl. ..... 439/537; 439/531; 439/657

(58) Field of Classification Search ..... 439/529, 439/641, 643, 648, 657, 661, 531, 576, 537, 439/302, 306, 236

See application file for complete search history.

(56) References Cited

U.S. PATENT DOCUMENTS

| | | | | | |
|---|---|---|---|---|---|
| 3,638,170 | A * | 1/1972 | Clement et al. | ..... | 439/537 |
| 4,046,448 | A * | 9/1977 | Miller | ..... | 439/640 |
| 4,327,402 | A * | 4/1982 | Aubrey | ..... | 362/288 |
| 4,565,419 | A * | 1/1986 | Johnson et al. | ..... | 439/641 |
| 4,595,969 | A * | 6/1986 | McNair | ..... | 362/440 |
| 4,807,099 | A * | 2/1989 | Zelin | ..... | 362/225 |
| 4,956,758 | A * | 9/1990 | Aubrey et al. | ..... | 362/285 |
| 5,731,663 | A * | 3/1998 | Davis | ..... | 315/194 |
| 6,616,112 | B1 * | 9/2003 | Tseng | ..... | 248/342 |
| 7,153,167 | B1 * | 12/2006 | Switzer | ..... | 439/642 |
| 7,247,049 | B2 * | 7/2007 | Ratican | ..... | 439/537 |
| 2003/0235049 | A1 * | 12/2003 | Wu | ..... | 362/252 |
| 2006/0013009 | A1 * | 1/2006 | Falco, Jr. | ..... | 362/418 |
| 2007/0014118 | A1 * | 1/2007 | Shourds | ..... | 362/407 |
| 2007/0127234 | A1 * | 6/2007 | Jervey, III | ..... | 362/147 |

* cited by examiner

*Primary Examiner*—Briggitte R Hammond
*Assistant Examiner*—Vanessa Girardi
(74) *Attorney, Agent, or Firm*—Paul Denk

(57) ABSTRACT

A conversion connector supports a suspended lamp, and which can threadily engage within the socket of a recessed lighting fixture, provides for an instant conversion of a recessed light or ceiling socket to a hanging lamp, for installation within any facility. The single male conversion connector has a threaded sleeve located axially upon an insulator. The insulator electrically connects to the wires of a hanging lamp. The insulator fits securely within a base fastened to a housing where the threaded sleeve extends outwardly from the housing for turning into a recessed light fixture, generally an incandescent light socket. The connector provides a housing that orients the connector upwardly for installation. Such a connector can be easily removed by unthreading the sleeve from the socket and the lamp can be replaced with another, or a different reflector, or shade, to add to the uses and displays associated with a variety of suspended and hanging lamps.

9 Claims, 5 Drawing Sheets

HANGING LAMP CONVERSION CONNECTOR

CROSS REFERENCE TO RELATED APPLICATION

This continuation application claims priority to the non-provisional application having Ser. No. 11/880,176, filed Jul. 20, 2007 now abandoned, which claims priority to the non-provisional application Ser. No. 11/388,736 which was filed on Mar. 24, 2006, now U.S. Pat. No. 7,247,049, and which claims priority to the provisional application for patent Ser. No. 60/665,681 which was filed on Mar. 28, 2005.

BACKGROUND OF THE INVENTION

This invention relates generally to the mounting of a lighting fixture, and more specifically pertains to a conversion connector that provides for the changing of a ceiling lamp, such as a recessed light, to a hanging style of lamp that can be easily changed, at the desire of the occupant, so as to convert quickly the style of decorative light hanging within a facility.

Lighting for the home, business installation, a restaurant, night club, bar, or any other business establishment, has long been available in the art. Of more recent vintage, though, the use of recessed lighting has become quite in vogue over the past twenty-five to thirty years. Recessed lighting can now be found in restaurants, taverns, even in business establishments, where the lights are mounted into a false ceiling, and such type of recessed lighting has even become stylish for installation into the residential building. Such lighting is not only attractive, but has been readily accepted by the home or business owner, to sustain its popularity.

Furthermore, in earlier years, a suspended or hanging type of light was of interest to particularly the homeowner, where a suspended light could be located over an end table, kitchen table, dining table, or any other location, where more proximate lighting was desired. But, when recessed lighting is installed within a facility, few means exist to allow an owner to convert from that type of lighting, to a suspended or hanging lamp, when desired.

A variety of patents have issued upon various types of lighting systems. For example, the U.S. Pat. No. 4,046,448, to Miller, shows a lighting fixture accessory, which is basically a telescoping type of housing for use for supporting a light socket, so that the housing can be expanded, or contracted, as desired, within a light socket of a facility.

The U.S. Pat. No. 4,327,402, to Aubrey, shows another light fixture. In this particular instance, the light fixture and its housing can be extended downwardly, by disengaging various latches, to allow for a lengthening of its light support, to bring the light either closer to the source of usage, or it can be contracted back up towards the ceiling, as desired.

The U.S. Pat. No. 4,595,969, to McNair, shows a lamp mounting apparatus and method. This apparatus is identified as for use for fitting within a recessed type of lighting fixture. But, the reflector of the shown light actually fits against the cover of a recessed receptacle, of the recessed lighting, and does not really provide for any extension or hanging of a lamp therefrom, because it appears that the reflector is originally connected up to and against the recessed fixture, during its assembly.

The U.S. Pat. No. 4,807,099, to Zelin, shows another lighting fixture. This particular device, as with some of the previously patented devices, is more concerned with furnishing fluorescent lighting, and its fixture, that may be interchangeable with an incandescent lighting fixture, that is recessed within the ceiling. As can be seen, it appears that the lighting fixture of this invention incorporates a lip adapter, which apparently is intended to conform to the light fixture that is mounted into the ceiling, of the recessed lighting installation, and not as a hanging lamp.

Another U.S. Pat. No. 4,956,758, to Aubrey, et al., shows a lamp mounting apparatus and method. Once again, this particular lamp mounting apparatus provides means for converting from an incandescent to a fluorescent type of light. In its design, it incorporates its fixture, to fit within the conventional recessed lighting fitting, so that its shoulder will bias against the recessed housing. And, the fluorescent lighting is then hardwired through wiring, into the ceiling, and connected through its screw connector, into the recessed lighting socket. Once again, this device relates to a lamp mounting apparatus, rather than means to provide for exchanging of a hanging lamp, into a recessed lighting fixture.

Finally, the published application of Wu, No. US 2003/0235049, shows a decoration bulb assembly. This device does not appear to relate to any type of recessed lighting fixture, but rather, simply discloses a decorative type of bulb, that emanates from its adapter, that can simply be screwed directly into a socket, at the ceiling or surface level of the facility. This does not relate to any type of an extension or converter for furnishing support, structurally, for a hanging lamp, from a recessed lighting fixture.

SUMMARY OF THE INVENTION

This invention relates generally to a hanging light conversion connector, and more specifically to a uniquely designed connector that can turn into a recessed lighting socket, and convert the lighting to a suspension or hanging lamp, at the desire of the occupant.

As previously stated, in reviewing the background of this invention, recessed lighting has long been available in the art. The concept of this invention is to convert the recessed light, to a hanging lamp, so that a variety of lamps, and their particular designs or ornamental appearances can be changed, at the selection of the occupant, as desired. For example, hanging lamps can be applied that reflect the seasons of the year, as within a restaurant, a sports bar, and the like. Or, depending upon the game to be televised in the sports bar for that day, the hanging lamps could be installed that display the various competing teams' colors, emblems, or the like, to add to the enthusiasm of the crowd.

In its primary construction, the concept of this invention is to replace the flood lamp, of a recessed light, with a hanging light fixture. The hanging light fixture can be screwed into the recessed lighting socket. Essentially, this invention is a type of uniquely designed screw-in plug, that can be threadedly engaged into the light fixture, even up in its recessed area, and the connector can have a screw-in type of plug, of the type that a lighting fixture can be hardwired to, and connected to its base, for support for the hanging lamp, during installation. The connector has a light type socket, provided at its bottom, and the wires from the lamp will extend into its opening, and be hardwired therein. Then, the double ended threaded connector will rotate its threads into the upper end of the socket, and the other threaded end of the double plug can rotate its threads directly into the socket provided in the removed recessed light. A hanging lamp can then be screwed directly into the socket for the recessed lighting fixture. Thus, when the light switch for the recessed light is turned on, the hanging lamp will light, to provide for illumination, and the reflection of the design, indicia, or coloration, that is desired for the style of hanging lamp connected thereto. As stated, in this manner, a variety of hanging lamps can be interchanged, for displaying something that may bring lighting closer to the user, or to add to the decorativeness of the facility.

It is, therefore, the principal object of this invention to provide means for converting a recessed light fixture into a support and electrical connector for a hanging lamp, or a variety of hanging lamps for use in a facility, or even a house.

Still another object of this invention is to provide a conversion connector for a hanging lamp, that may be threadedly engaged directly into the socket of a recessed light, and thereby provide for not only the conversion of the lighting to a hanging lamp, but one that may be changed multiple times to vary the attractiveness and decorativeness of the lighting for the facility in which such hanging lamp is installed.

Yet another object of this invention is to provide a conversion connector that may be integrated into a thread-in plug, and yet provide terminals for hardwiring a hanging lamp thereto, when converting recessed lighting to a hanging lamp, within a facility or home.

Yet another object of this invention is to provide a conversion connector that can be promptly and easily installed, for changing residential or commercial lighting into the hanging style lamp.

These and other objects may become more apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
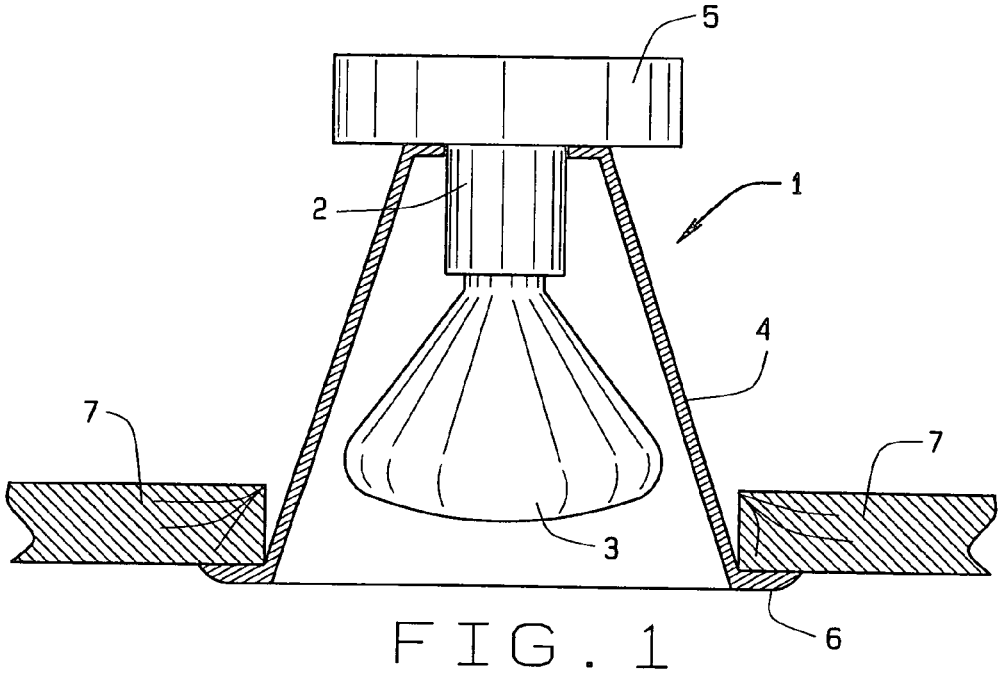
FIG. 1 PRIOR ART
FIG. 1 shows a prior art recessed lighting fixture, and its flood lamp, installed within a ceiling.

In referring to the drawings, FIG. 1 shows the standard style of recessed lighting fixture, as at 1, which has a socket 2, holding a lamp 3, as may be installed. The housing 4 for the recessed fixture secures to the socket base 5, at its upper end, and at its lower end, normally includes flanges, or at least a continuous flange, as at 6, and which supports or connects with the ceiling material 7 normally of a suspended ceiling structure.

Figure 2:
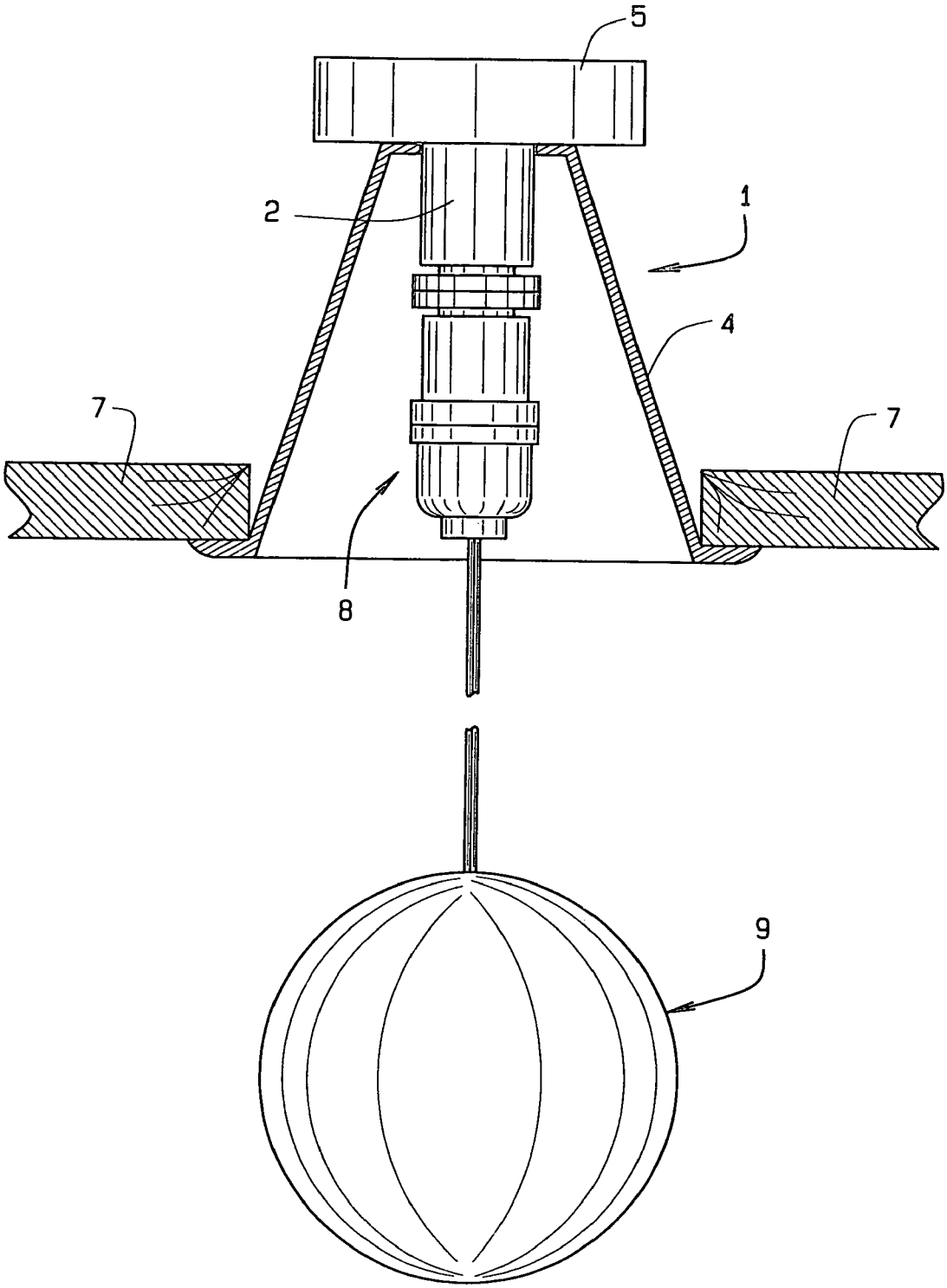
FIG. 2 shows the conversion of the recessed lighting fixture into an electrical and structural support for a hanging lamp.

FIG. 2 shows similar type of structure, for a recessed lighting fixture, but in this instance, includes the conversion connector 8 that threadedly engages within the socket 2, and provides for suspending of the hanging lamp 9.

Figure 3:
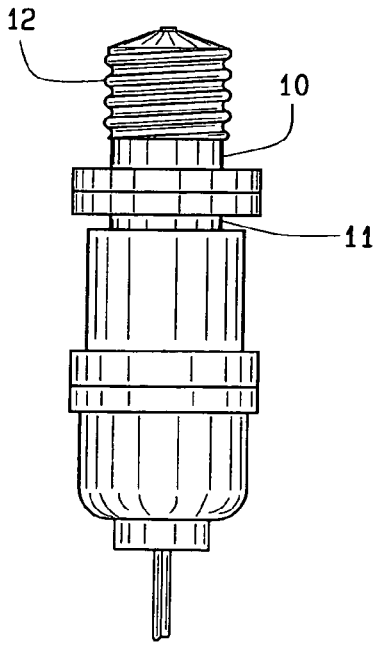
FIG. 3 shows the conversion connector, enlarged, as disclosed in FIG. 2.
Figure 4:
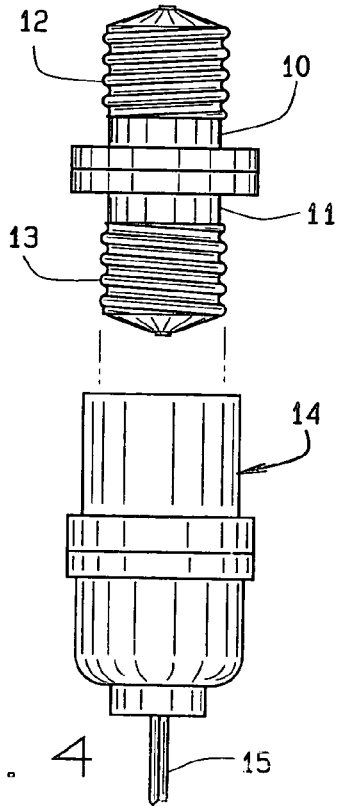
FIG. 4 shows the double ended plug removed from the light socket for the hanging lamp.

The conversion connector of this particular invention is also shown in FIGS. 3 and 4. It includes a double ended threaded engaging plug, the two plugs being connected back to back, as can be seen at 10 and 11. Normally, each of these plugs are of the standard type, which includes its threaded segment 12 which in this instance, can threadedly engage directly into any socket 2 for a recessed lamp, while the other plug likewise includes a series of threads, as at 13, and which can thread directly into a light socket, as at 14, of the type as known in the art. When the conversion connector is assembled in this manner, the electrical wires 15 from the hanging lamp, can be connected into the connector, internally, thereat as known in the art, and the double plug can then be threadedly engaged therein, within the light socket 14, but also into the socket 2 for the recessed lighting fixture, to provide for an instant conversion of the flood lamp 3, into a hanging lamp, and as previously explained, with respect to FIG. 2.

Figure 5:
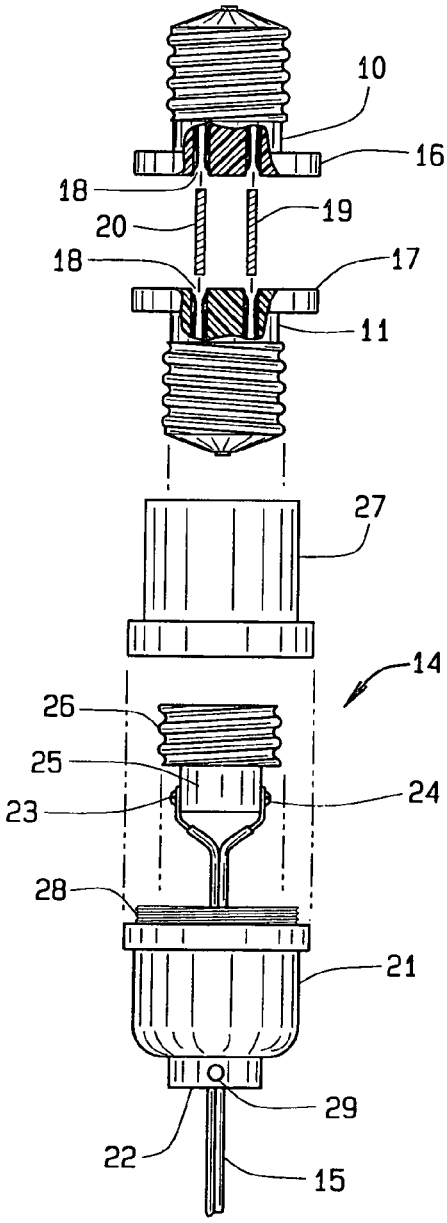
FIG. 5 shows an exploded view of the double ended threaded plug, with the electrically conductive tabs arranged intermediate thereof, and which can be threadedly engaged within the lamp socket for the hanging lamp.

The specific construction of the conversion connector 8, as previously explained, can be seen in FIG. 5. Each of the threaded plugs 10 and 11, as known, at their flanged ends, as at 16 and 17, have their plug in openings 18 and before these two plugs are sealed together, either by adhesive, or molding, as along the surface of their flanges 16 and 17, the electrical conducting tabs 19 and 20 are inserted into their respective plug in locations, as at 18, to provide for electrical connection from the upper threaded plug 10, to the lower plug 11, once assembled and installed. The bottom portion of the conversion connector includes, what was previously identified as the light socket 14, and includes the base of the socket 21, having an opening at its lower end, as at 22, through which the electrical wiring 15 from the light fixture extends.

The pair of wires then connects by threaded fasteners, as at 23 and 24, to the base 25 of the threaded socket 26, as known in the art. Then, the upper part of the light socket, as at 27, is lowered to surround the threaded socket 26, and then threadedly engages onto the sleeve threads 28 of the lower portion 21 of the light socket, as can be seen. When the entire unit is assembled, so that it appears as shown in FIGS. 3 and 4, the double socket plugs 10 and 11 are then threaded into the sleeve threads 26, to provide for electrical connection completely through the conversion connector, which is then readily assembled for installation into the recessed lighting fixture socket 2, as described.

Thus, when assembled in that manner, the entire conversion connector has the appearance as shown in FIG. 2, it is generally concealed within the housing 4 of the recessed lighting fixture, and is not that observable to any occupant of the room, in which the hanging light fixture is located. In fact, because the light fixture 9 may have the variety of colors, designs, indicia, or other pictures applied thereto, the line of vision of the room occupant will be towards the fixture, and not up into the ceiling, as can be understood. While it is not shown, any type of reflector, or cover, can be applied at the base of the conversion connector, so as to cover the opening into the recessed lighting fixture housing 4, to provide greater concealment for the electrical installation. In addition, to provide greater support for the hanging lamp 9, a fastener, as at 29, may be provided at the bottom of the lamp socket, and be tightened about the wires, to support them in position, and to aid in supporting the weight of the hanging lamp fixture 9, once installed. Or any type of chain or other support can be applied, as known in the art.

Figure 6:
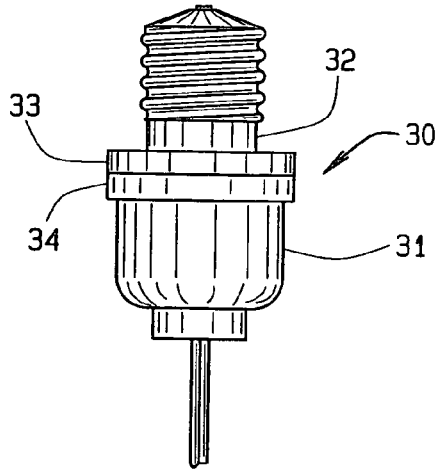
FIG. 6 shows a modification to the hanging light conversion connector of this invention.
Figure 7:
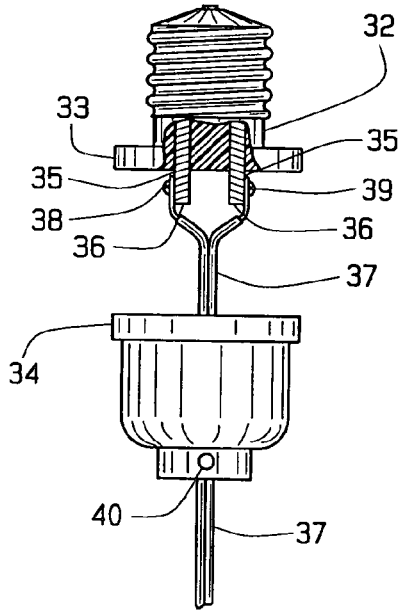
FIG. 7 discloses the modified conversion connector, in partial exploded view, having the electrical wiring from the hanging lamp extending into the connector and connecting with the terminal tabs of the socket plug.

FIGS. 6 and 7 disclose a further variation upon the conversion connector of this invention. The conversion connector, as shown at 30, includes the lower structure of the light socket, as can be seen at 31, and has a threaded plug 32 secured thereto, by means of an adhesive or other connection between their flanges 33 and 34, when connected together. Thus, when assembled in this manner, it can provide for electrical connection within the recessed lighting fixture, and its socket 2, but at the same time, support a hanging lamp, in the manner as previously described. Hence, because it may be desirable to separate the threaded plug 32, from the lamp base 31, the inner connection between the flanges 33 and 34 may be through a threaded connection, so that they may be unthreaded, for separation, to allow one to attain access into its internal electrical connectors, as can be seen in FIG. 7. As noted, the threaded plug 32 has its receptacle slots 35 provided therein. And, the electrical tabs 36 extend into the receptacles, to provide for electrical connection. Then, the electrical wires 37 from the hanging lamp can be fastened to each of the electrical tabs 38 and 39, so to conduct charge through the plug 32, from the socket 2, and through the electrical tabs 36, through the connected electrical wires 37, and to the hanging light fixture, to provide for its illumination, when charge is being conducted. In addition, once again, a fastener, as at 40, can secure the electrical wires 37, or an associated chain, to hold them in position, and to support the weight of any light fixture suspended therebelow.

In addition, it may be just as likely that the flanges 33 and 34 of the threaded plug 32, and the lamp housing 31, can be threadedly engaged together, in a manner similar to that which the upper socket housing 27 threadedly engages onto the threaded sleeves 28, of the lamp socket 14 as disclosed in FIG. 5.

Figure 8:
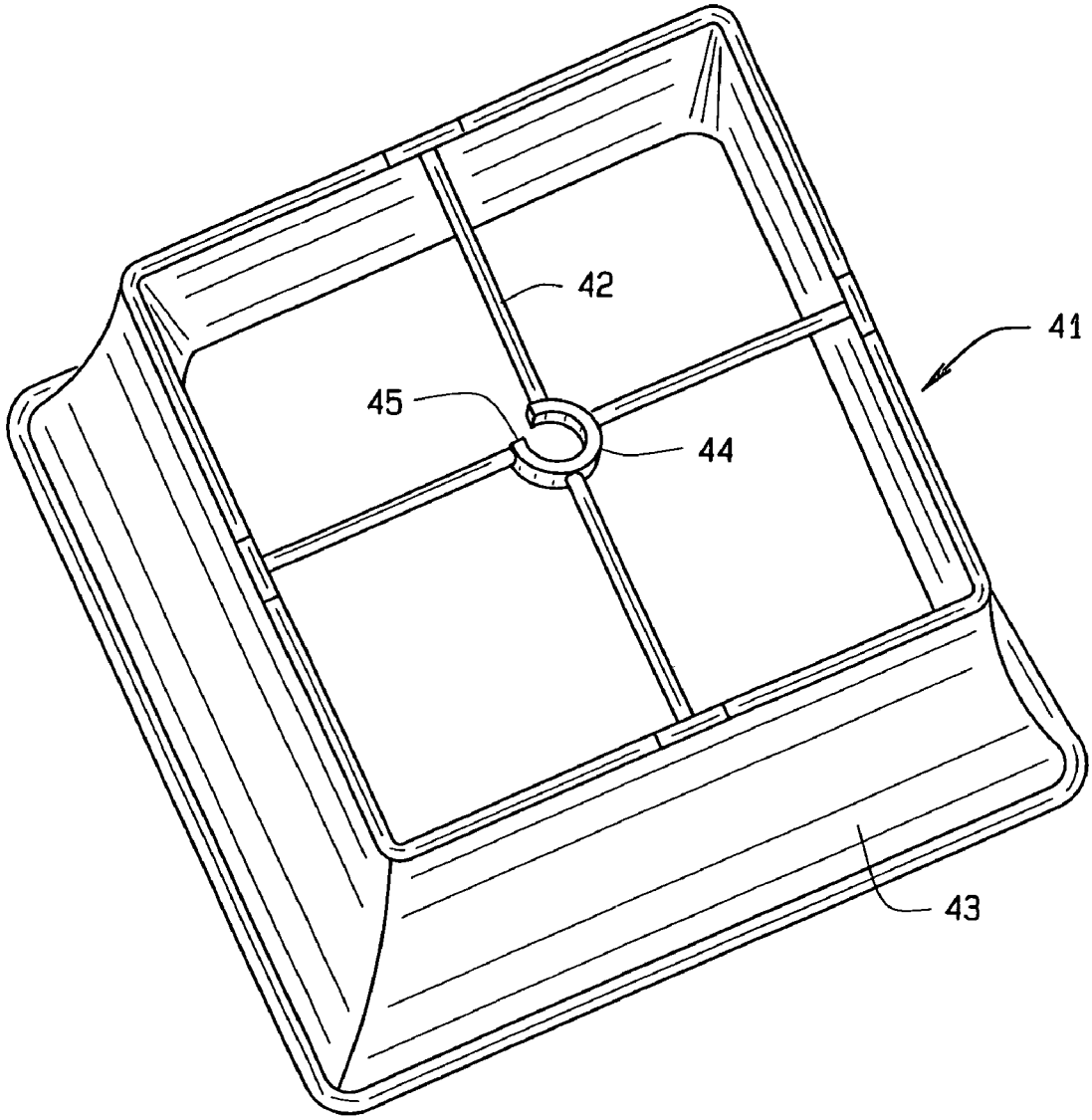
FIG. 8 is a perspective view of a type of shade that may be applied to the end of the hanging lamp to provide cover for the light, and to display various types of other decoration, such as emblems for sport teams, etc.

As shown in FIG. 8, this is an example of the type of shade that may be applied to the hanging lamp connector, at the lower end of its cord, and where the lamp will plug into the same. The type of shade or reflector that may be applied to the lamp, as previously described in FIG. 2, indicated at reference character 9. Different types of shades, globes, or any other types of reflector, that may bear indicia of different sport teams, community sites, even the name of the nightclub or restaurant, or any type of nomenclature, as desired by the owner, can be used. As can be seen, in FIG. 8, shade 41 includes the usual frame 42, for supporting the shade covering 43, and the means for connection of the shade to the wires 15, 37, or even any chain that suspends from the connector 8, includes the supporting ring 44. In this particular instance, the supporting ring 44 includes a slot 45, and through this slot the cord will be applied, and then can be secured by any type of a fastener or any type of a threaded connecting means, that can hold the cord or chain to the ring 44, in suspension. The end of the electrical wires is a common type of screw in socket, similar to what has been described with respect to the light socket 14, but will be located at the opposite end of the wires, at its downward most point, and where the lamp will be reapplied, and one of the lamps, bowls, reflectors, such as 9, or shade 41, is applied thereat, for surrounding the light, and allow for projection of any applied indicia, trademarks, and the like.

Figure 9:
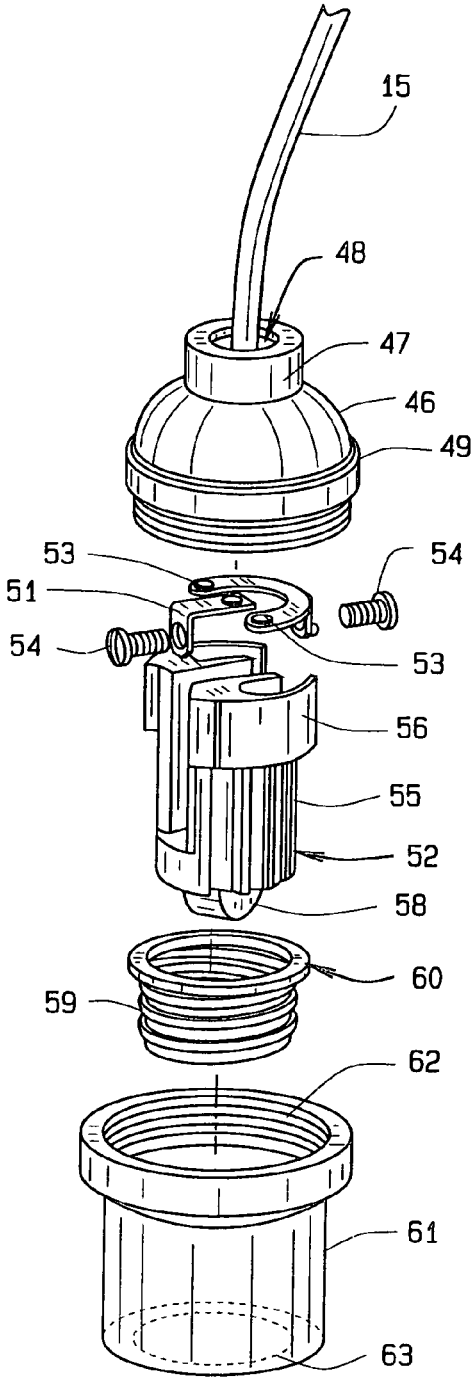
FIG. 9 is an exploded view of the single male connector of the present invention; and, FIG. 10 is a side view of the single male connector ready for placement within the socket of a light fixture.

Separating from the single plug embodiment of FIG. 7, FIG. 9 describes the assembly of a single male conversion connector but, without plug like blades. This embodiment of a single male socket has a pair of wires 15 that enters a base 46 for electrical connection to the remainder of this connector. The base is generally partially spherical with an entrance 47 at the top of the sphere that admits the wires 15. The entrance is generally round and of lesser outside diameter than the remainder of the base. The entrance is spaced above the base to reinforce the base and the entrance against the movements of the wire. The entrance has an aperture 48, generally round through which the wires proceed into the base. The base is generally hollow and opposite the entrance, the base has a lip 49 generally round and threaded. The threaded lip cooperatively engages the housing as later described.

Here shown beneath the base, the present invention has a plate 50 and a tongue 51 that connect to an insulator 52. The plate is generally planar and has a generally arcuate shape with two ends 53. The tongue, generally centered within the ends 53 of the plate, also has an end 53 generally in line with the ends of the plate. The plate and the tongue connect to the insulator using mechanical fasteners or screws 54 into corresponding threaded apertures, or alternatively cooperating flanges within the insulator. The tongue and plate electrically communicate with the wires 15 and extend along an insulator 55.

The insulator 55 has a generally elongated shape with two ends and a round cross section though other cross sections such as rectangular are possible. Upon one end, the insulator has a shoulder 56 that extends partly around the perimeter of the insulator and has a greater diameter than the remainder of the insulator. The shoulder extends partially along the length of the insulator. Beneath the shoulder, the insulator 55 has a shank 57 extending downwardly. The shank is generally elongated and of lesser diameter than the shoulder. In this embodiment, the shank has a plurality of flutes extending lengthwise upon the perimeter. Opposite the shoulder 56, the insulator has a tip 58 extending below the shank. The tip is generally rounded and of lesser width than the diameter of the shank. The tip has two parallel flat faces and the narrow portion of the tip extends outwardly of the assembled socket. In the preferred embodiment, the insulator is a ceramic or another high resistance material.

Here shown beneath the insulator, the present invention has a threaded sleeve 59 of greater diameter than the shank 57 but slightly less diameter than the shoulder 56. The sleeve is hollow and has circumferential threads at a pitch for a common light socket, generally a U.S. incandescent light socket. Though a U.S. socket is described, this invention can be fitted with various shaped sleeves and insulators to fit sockets of other shapes and configurations. The sleeve is open upon both ends for placement over the shank. Upon one end, generally proximate the insulator, the sleeve has a flange 60 that extends outwardly upon the perimeter of the sleeve.

And beneath the sleeve, FIG. 9 shows the housing 61. The housing is generally a hollow cylinder with a reinforced threaded first lip 62. The first lip receives the threads of the lip 49 from the base. Opposite the first lip, the housing has a second lip 63 that extends partially into the interior of the housing. The second lip extends along the entire perimeter of the housing. When the connector of the present invention is assembled, the flange 60 abuts the second lip 63 internally thus retaining the sleeve 59 within the housing and preventing the sleeve from rotating as the connector is turned into a socket. The flange secures to the second lip with adhesive, mechanical fasteners, or cooperating threads.

Figure 10:
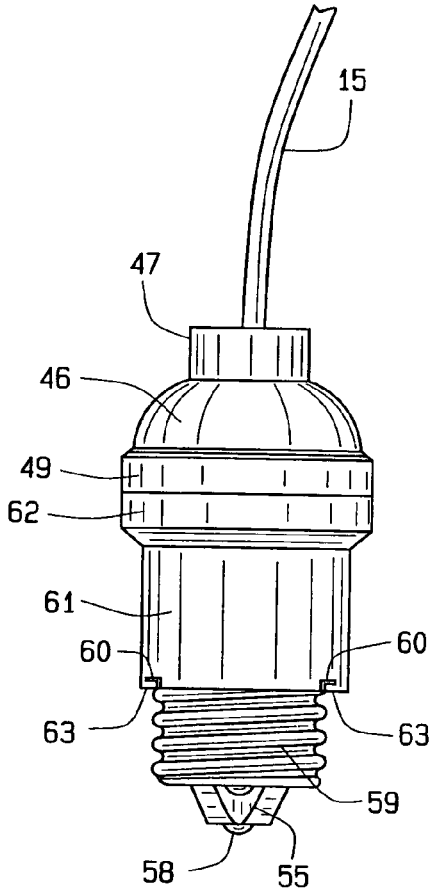

FIG. 10 shows the assembled connector of the present invention ready for installation into a light socket. The connector has wires 15 approaching the entrance 47 of the base 46. The base has engaged the threaded first lip 62 of the housing 61 with the threaded lip 49 of the base. The insulator 55 with the attached plate 50 and tongue 51 are located concentrically within the base and the housing. The insulator has the threaded sleeve 59 extending outwardly and opposite the base. Generally, the sleeve is axially aligned upon the insulator and partially within the housing. The flange 60 of the threaded sleeve abuts the internally positioned lip, or second lip 63, here shown in phantom, of the housing. The threaded sleeve then leads to the exposed tip 58 of the insulator. Upon installation of the present invention, the tip 58 contacts the center bottom of the socket and the threaded sleeve 59 contacts the threads of the socket to complete the electrical circuit transferring power from the socket to the wires of a handing light fixture below the connector of the present invention. The base and the housing as shown are also in axially alignment, thus forming a compact single male socket.

The type of hanging lamp conversion connector, described as connecting within a recessed lighting fixture, could also be applied to any light socket in a ceiling, where it is desired to suspend a hanging lamp, in lieu of the ceiling light, to add to the decorativeness of the installation. Thus, in many old homes, and even contemporary ones, where light sockets are applied at ceiling level, regardless whether they are recessed or not, could use this conversion connector as a means for suspending and operating a hanging lamp, rather than a ceiling mounted fixture. This is an example as to how this conversion connector can be applied.

Hence, the essence of this invention is to provide a conversion connector, which has not been available in the prior art, and is not known to be available for use for converting a recessed lamp into a hanging lamp fixture, in the manner as described herein. Through the use of this type of conversion connector, the type of assembly, its installation, and replacement with another hanging lamp, can be readily achieved as described herein, for the installation as shown and explained.

The single male hanging lamp conversion connector and its various components may be manufactured from many materials, including but not limited to, steel, aluminum, ferrous and non-ferrous metals, their alloys, polymers, polyvinyl chloride, high density polyethylene, polypropylene, Bakelite®, nylon, rubber, ceramics, and composites.

The purpose of this invention is to provide an adapter, as a form of conversion connector, that is designed to be a "universal" type of adapter that will enable a hanging lamp, of any variety, for application to a ceiling, by converting a ceiling level type light to a hanging lamp, to provide better esthetics and furnish greater capabilities to the lighting furnished in a room or any establishment. In addition, this device could be used to allow for the adaptation of any ceiling lighting fixture, to allow to be converted for furnishing electrical charge to any cord that suspends from the adapter, after the adapter has been plugged into the ceiling light outlet.

Variations or modifications to the subject matter of this development may occur to those skilled in the art upon review of the invention as described herein. Such variations, if within the spirit of this development, are intended to be encompassed within the scope of the invention as explained. The description of the preferred embodiment and as shown in the drawings, are set forth for illustrative purposes only to show the principle of this hanging lamp conversion connector.

I claim:

1. A hanging lamp conversion connector for converting a recessed ceiling light socket to provide electrical connection to a hanging lamp, comprising:

a male socket with at least two wires connecting to said hanging lamp;

said male socket including a base, generally round, said base having a lip, a housing generally round and cylindrical, said housing having a first lip that engages said lip of said base and an inwardly oriented second lip opposite said first lip;

said male socket further including an elongated insulator having two spaced apart ends and a tip upon one end, a plate and a tongue secured to said insulator upon said end opposite said tip, a threaded sleeve into which fits said insulator, said sleeve being in electrical communication with said plate and said tip in electrical communication with said tongue, said plate being in electrical communication with one of said wires and said tongue being in electrical communication with another of said wires;

said sleeve and said insulator axially aligned within said base and partially within said housing; and, then said base and said housing being axially aligned wherein said lip of said base secures to said first lip of said housing.

2. The hanging lamp conversion connector of claim 1 further comprising:

said base having an entrance through which said wires insert opposite said lip and said lip incorporating integral threads;

said first lip of said housing incorporating integral threads wherein said first lip threadily engages said lip of said base;

said threaded sleeve having a perimeter flange upon one end; and, said second lip of said housing receiving said flange thus retaining said threaded sleeve within said male socket.

3. The hanging lamp conversion connector of claim 1 further comprising:

said insulator having at least one shoulder generally opposite said tip, a shank below said shoulder terminating in said tip, said shoulder having a greater width than said shank, at least two integral threaded apertures proximate said shoulder, and at least two threaded fasteners connecting to said threaded apertures, to said plate, and to said tongue, and said wires connecting to said fasteners; and, said insulator locating within said housing and said threaded sleeve extending outwardly of said housing when said base and said housing are threadily engaged with said electrical wire extending downwardly through said entrance of said base for suspending a hanging lamp therefrom.

4. The hanging lamp conversion connector of claim 3 further comprising:

said plate having a generally planar arcuate shape and two ends being in electrical communication with said threaded sleeve; and, said tongue having a generally L-shaped cross section and at least one end, generally centered upon said insulator and being in electrical communication with said tip.

5. The hanging lamp conversion connector of claim 2 wherein said flange secures to said second lip of said housing by one of an adhesive, threaded connection, or integral molding.

6. The hanging lamp conversion connector of claim 1 further comprising:

said base having an entrance through which at least one electrical wire inserts opposite said lip, said lip incorporating integral threads, a housing of said socket provided for engaging with said sleeve when said socket is reconnected after wiring, an insulator included within said socket and having a pair of threaded fasteners to which said wires connect, and said insulator located within said housing and said base when said housing and said base are threadily engaged, and said wires extending downwardly through said entrance of said base of said socket for connecting and suspending a hanging lamp therefrom.

7. The hanging lamp conversion connector of claim 6 further comprising:

said insulator having two ends, a shoulder upon one end and an opposite tip upon the other end, and a shank beneath said shoulder extending to said tip;

said shoulder supporting said plate and said tongue in electrical communication with said wire and said ceiling socket.

8. The hanging lamp conversion connector of claim 7 wherein said insulator is selected from one of ceramic, plastic, polymer, or composite.

9. A hanging lamp conversion connector for converting a recessed ceiling light socket to provide electrical connection to a hanging lamp, comprising:

a male socket and at least two wires connecting to said hanging lamp;

said male socket including an elongated insulator, generally round, and said male socket including a shoulder integral with said insulator, a housing generally cylindrical, said housing having a first lip that engages the shoulder of the socket, and a base securing to said housing;

said male socket further including said elongated insulator and having two spaced apart ends, and a tip upon one end, a plate and a tongue secured to said insulator upon said opposite end, a threaded sleeve fitting onto said insulator proximate its one end and being secured thereto, said sleeve being in electrical communication with said plate and said tip being in electrical communication with said tongue, said plate being in electrical communication with one of said wires, and said tongue being in electrical communication with another of said wires;

said threaded sleeve and said insulator being axially aligned, and said insulator partially locating within said base, and said sleeve and insulator being fixed within said housing;

said base and said housing being axially aligned and connecting together to secure the insulator therein when forming the conversion connector.

* * * * *